US007308973B2

(12) United States Patent
Dziwak

(10) Patent No.: US 7,308,973 B2
(45) Date of Patent: Dec. 18, 2007

(54) DOOR INTERLOCKING SYSTEM

(75) Inventor: Zygmunt Dziwak, Mississauga (CA)

(73) Assignee: The Peelle Company Ltd., Brampton, Ontario (CA)

( * ) Notice: Subject to any disclaimer, the term of this patent is extended or adjusted under 35 U.S.C. 154(b) by 337 days.

(21) Appl. No.: 11/033,091

(22) Filed: Jan. 10, 2005

(65) Prior Publication Data

US 2006/0151253 A1 Jul. 13, 2006

(51) Int. Cl.

| | |
|---|---|
| ***B66B 13/06*** | (2006.01) |
| ***B66B 13/12*** | (2006.01) |
| ***A47H 5/00*** | (2006.01) |
| ***E05F 11/44*** | (2006.01) |

(52) U.S. Cl. ..... 187/330; 187/324; 187/333; 187/334; 49/351; 160/84.09

(58) Field of Classification Search ..... 187/324, 187/330, 333; 49/324, 351, 363; 160/84.09, 160/84.11, 199

See application file for complete search history.

(56) References Cited

U.S. PATENT DOCUMENTS

| | | | | |
|---|---|---|---|---|
| 546,998 | A | 10/1895 | Crane et al. | |
| 662,095 | A * | 11/1900 | Rubbert | 49/101 |
| 856,369 | A | 6/1907 | Ritter | |
| 1,069,074 | A | 7/1913 | Voight | |
| 1,141,479 | A | 6/1915 | Mueller | |
| 1,434,171 | A | 10/1922 | Voight | |
| 1,543,935 | A | 6/1925 | McGee | |
| 2,244,840 | A | 6/1941 | Hulburt | |
| 4,075,708 | A * | 2/1978 | Chen | 365/2 |
| 4,658,878 | A * | 4/1987 | Williams | 160/84.09 |
| 5,163,494 | A * | 11/1992 | MacNeil et al. | 160/201 |
| 5,235,723 | A * | 8/1993 | Wallis | 16/78 |
| 6,061,965 | A * | 5/2000 | Schrock | 49/360 |
| 6,296,038 | B1 * | 10/2001 | Chen | 160/199 |
| 6,330,902 | B1 * | 12/2001 | Chen | 160/231.2 |

FOREIGN PATENT DOCUMENTS

| | | |
|---|---|---|
| BR | 9 601 189 | 3/1998 |
| CH | 134 157 A | 7/1929 |
| CH | 137 825 A | 1/1930 |

OTHER PUBLICATIONS

Patent Abstract of Japan, vol. 016, No. 464 (M-1316), Sep. 28, 1992 & JP 04 164797 A (Toshiba Corp.) Jun. 10, 1992.

* cited by examiner

*Primary Examiner*—Patrick Mackey
*Assistant Examiner*—Terrell Matthews
(74) *Attorney, Agent, or Firm*—Pearne & Gordon LLP

(57) ABSTRACT

A door panel position control mechanism for a multiple panel horizontal sliding door assembly of a freight elevator landing. The mechanism comprises a multiple node scissors linkage that is configured to be easily installed and initially adjusted and which has its parts symmetrically balanced about a vertical plane such that excessive eccentric loading on the components is reduced and a long service life is obtained with reduced wear and a reduced need for periodic adjustment.

15 Claims, 4 Drawing Sheets

DOOR INTERLOCKING SYSTEM

BACKGROUND OF THE INVENTION

The invention relates to improvements in elevator landing door assemblies and, more particularly, to a position control mechanism for multiple horizontal sliding door panels.

PRIOR ART

Freight elevator landing doors of the multiple panel, horizontal sliding type typically have a device to produce simultaneous movement of the panels. A common type of control device uses a cable and pulley system to produce the desired movement rate and distance which, as between the panels are-typically different but proportional.

Conventional cable systems are prone to go out of adjustment due to permanent stretching of the cables and/or wear of related parts. Generally, the cable systems are disposed above the door panels thereby making their original installation as well as subsequent service adjustments awkward, tedious and time-consuming.

SUMMARY OF THE INVENTION

The invention provides a multi-panel motion control system for a freight elevator door landing having a simplified linkage arrangement that is easy to install, requires minimal initial adjustment, and is resistant to wear or other distortion effects that require periodic adjustment or replacement. The linkage of the invention is adapted to be mounted at mid-height on the door panels so that it can be easily installed and adjusted by a technician conveniently working on the level of the respective landing.

Preferably, the linkage is in a multiple scissors or X-like configuration so that the forces on individual links and pivot connections or pins are balanced and relatively low forces are imposed on the linkage. Consequently, the linkage has the potential of operating over an extended service life with a minimum of wear, and thereby reduces the need for periodic service adjustment or replacement. Mounting brackets for the linkage can be directly secured to the panels and minimum initial adjustment is required. While a pinching hazard at the linkage is remote because in operation the linkage is ordinarily shielded by the elevator car door, the mechanism can include shields to minimize the risk of personal injury or mechanical damage when the linkage is exposed during periodic inspection or maintenance.

DESCRIPTION OF THE PREFERRED EMBODIMENT

An assembly 10 of horizontal sliding door panels 11*a*-11*c*, is illustrated in the figures. The panels 11, for example, represent the right side of a six-panel door assembly. The left side of the assembly is symmetrical with and a mirror image of FIGS. 1 and 2. The panels 11 are supported on traction rollers 12 supported on overhead tracks 13 in a generally conventional manner.

Figure 3:
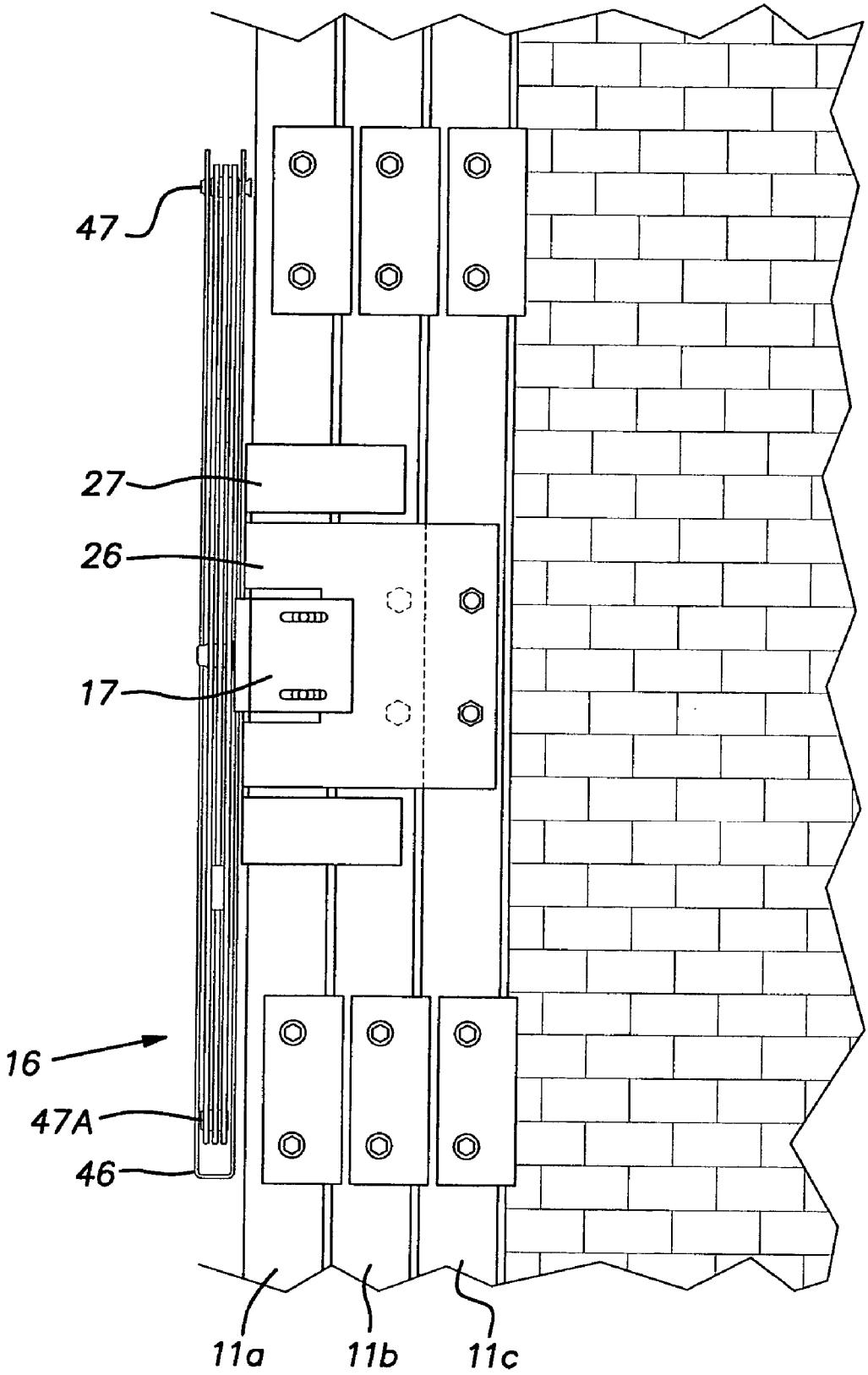
FIG. 3 is an elevational edge view of the control system and door panels from a vantage point lateral of the shaft opening.
Figure 4:
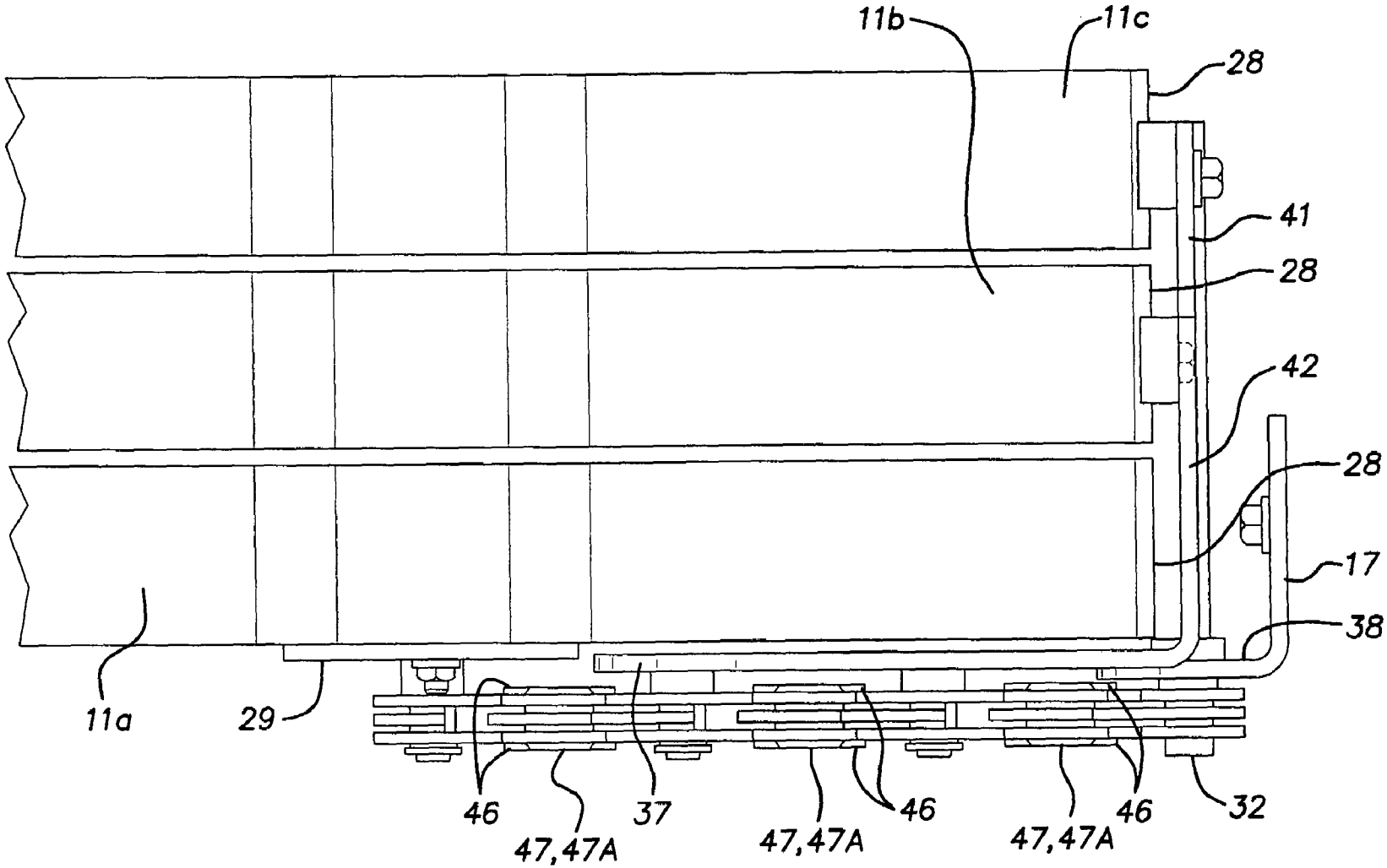
FIG. 4 is a plan view of the door control system and door panels in an open position.

The door panel assembly 10, as is typical, exists to close the shaft opening at a respective landing when an elevator car is elsewhere and opens for ingress and egress to the car when the car is present at the landing. The panels 11, as seen most clearly in FIGS. 3 and 4, are horizontally spaced or in staggered vertical planes so that they are able to register one behind the other as shown in FIG. 4 when in the open position.

When the panels 11 move between their respective open and closed positions, it is desirable that they all depart from and arrive at these positions at the same time. It follows that the inner door 11*a*, i.e. the door that is spaced farthest from the shaft wall, must move the farthest and, therefore, the fastest, from and towards the center line of the shaft opening (or if the entire door assembly comprises only three panels, to the opposite side of the opening). The position and rate of travel of the door panels 11 in accordance with the present invention, is controlled by a linkage assembly or system 16. The assembly 16 comprises a series of individual links pivotally connected to one another, to the panels 11, and to a fixed referenced member or end bracket 17. The links 18, 19 are substantially uniform in length being either a short length or a long length, respectively, the latter being substantially equal to twice the short length. The short length links 18 have operative pivot connections only at their ends, while the long length links 19 have operative pivot connections at their ends-and at their mid-lengths so that they form an X or scissors-like configuration with other links 19. As shown, the links 18, 19 are proportioned so that in relation to the width of the door panels 11 such that when the panels are in the closed position of FIG. 1, they are inclined from the horizontal by a substantial angle preferably at least about 30° so that high compressive forces along the axis of the links are avoided and the linkage 16 operates smoothly. The door panel 11*c*, at the right in FIG. 1, i.e. the door required to move the least distance between open and closed positions, is referred to as the slow door panel; the door panel 11*a* at the left in FIG. 1, i.e. the door panel required to move the greatest distance between open and closed positions, is referred to as the fast door panel; and the door panel 11*b*, in between, is referred to as the middle door panel.

The linkage assembly 16 comprises a series of nodes 21-23 corresponding to the number of sliding door panels it controls. The nodes 21, 23 associated with the slow and fast doors, respectively, comprise short links 18 and portions of long links 19, while the intermediate or middle panel 11*b* has its node comprised of portions of long links 19.

The end bracket 17 provides a fixed reference point for the linkage system 16. The bracket 17 is fixed by bolts to a rigid strut 24 or other stationary member spaced laterally of the landing-opening. The slow and middle door panels 11*c*, 11*b*, have associated L-shaped brackets 26, 27, as viewed in the plan view of FIG. 4, screwed to vertical edges 28 of their respective door panels. The fast door panel 11*a* has a bracket 29 attached to its side facing the shaft. This fast door panel bracket 29 carrying a pivot pin 30 is horizontally adjustable on the panel 11*a* by virtue of slots 31 receiving screws attaching it to the panel. At the other end of the linkage 16, a pivot pin 32 in the form of a shoulder bolt, is horizontally adjustable in a slot 33 in the bracket 17. The slow and middle door panel brackets 26, 27 support pivot pins 35.

Figure 1:
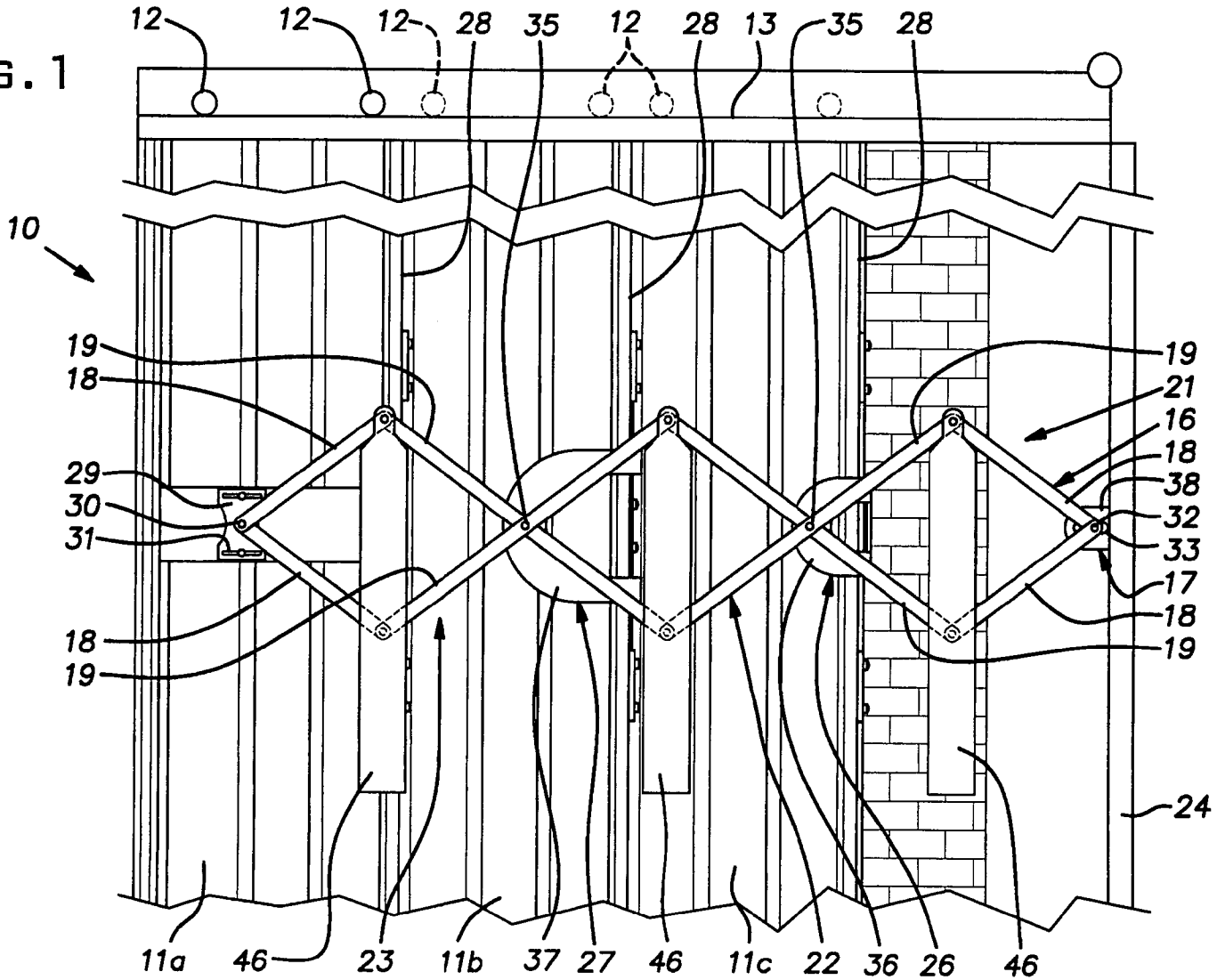
FIG. 1 is an elevational view from the inside of the elevator shaft of a door position control system constructed in accordance with the invention shown with associated door panels in a closed position.
Figure 2:
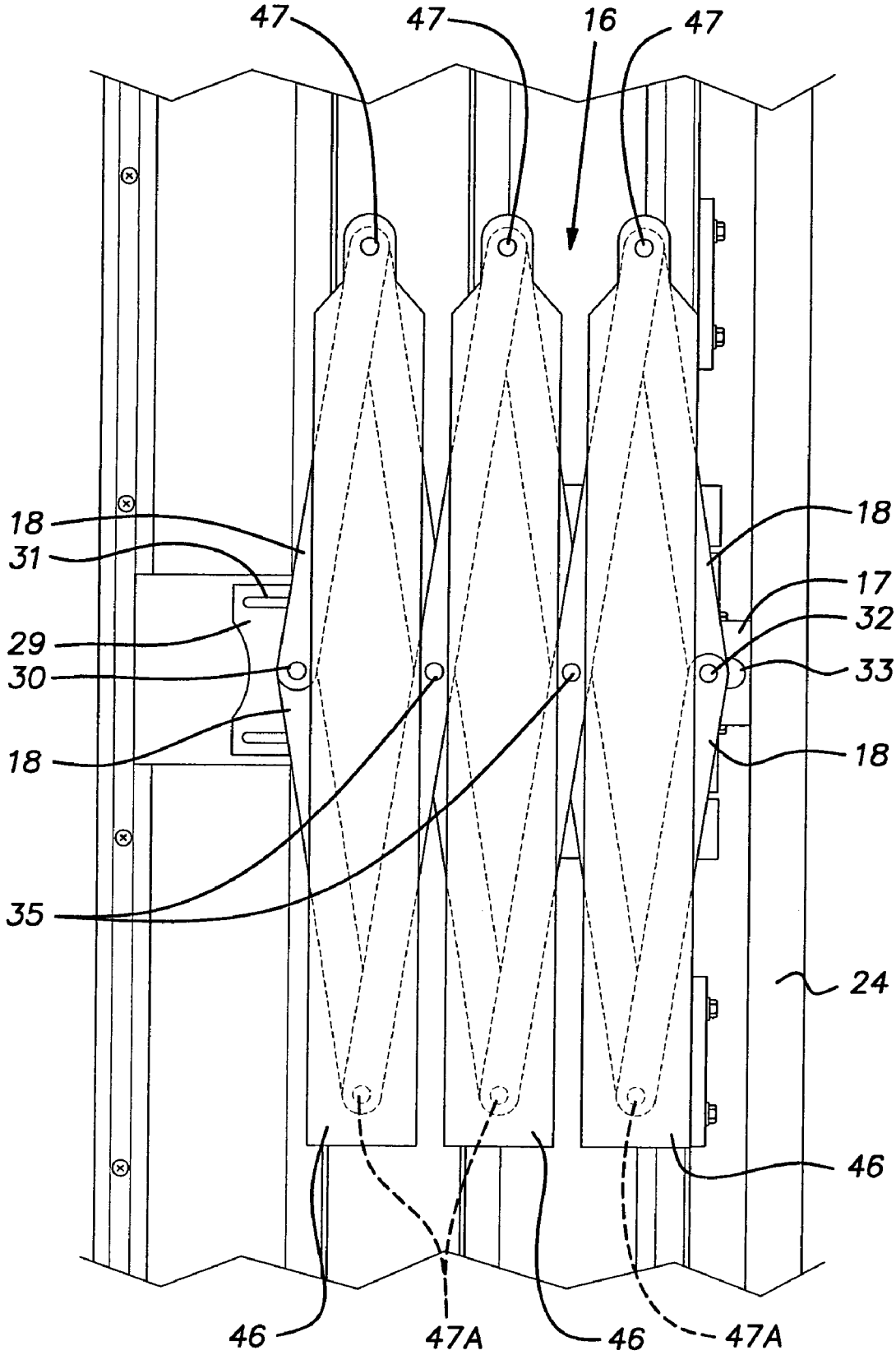
FIG. 2 is a view similar to FIG. 1, with the door panels and position control system in an open position.

As shown in FIGS. 1 and 2, the ends of the links remote from the bracket pins 30, 32, 35, are each pivotally connected to one or two link ends by common pins. The links 18, 19 are assembled on the bracket pins 30, 32, 35 and, as shown in FIG. 4, the pins are arranged to support the links in three closely spaced parallel, vertical planes. Alternate links are doubled (going from left or right in FIGS. 1 and 2, above or below the bracket pins) to straddle intervening single links. This straddling of intervening single links with double links tends to balance the operating forces on the links and pins and, thereby, avoids excessive eccentric loading on the parts and wear which would otherwise be attendant to such eccentric loading.

The slow, middle and end brackets 26, 27 and 17, are configured with pivot pin-supporting legs 36, 37, 38 that lie generally in a common vertical plane with the bracket 29 parallel to the door panels 11. To accomplish this, the slow and middle brackets 26, 27, have legs 41, 42 perpendicular to these pin supporting legs 36, 37 of different lengths, each sufficient to reach the edges of their respective door panels to which they are attached by suitable screws. Additionally, the pivot pin supporting legs 36, 37 are U-shaped so that the end bracket leg 38 can nest in the slow bracket leg 36, and the slow bracket leg 36 can nest in the middle bracket leg 37.

It can be seen that the pivot pin supporting bracket 29 on the fast door panel 11*a* is horizontally adjustable with slots 31 that accept screws that fix it to this door panel. The horizontal adjustability of the shoulder bolt 32 on the end bracket 17 and the fast bracket 29 enables the linkage 16 to be adjusted so that in the open position, the door panels 11 can be aligned with the landing opening frame.

A set of guards 46 is mounted on the linkage 16 to reduce the already limited risk that a serviceman's hand or tools might be pinched between the links 18, 19 when the door panels are being opened. The guards can be in the form of sheet metal or plastic strips that are assembled on pivot pins 47 coupling the ends of the links remote from the bracket pins 30, 32, 35. The guards 46 are U-shaped when viewed from the edge in FIG. 3. This U-shaped-configuration, with both vertical parts of the guard 46 pivoted on a respective pin 47, allows the guard to be relatively stiff so that it remains in a vertical plane. The illustrated curved profiles of the brackets 17, 26 and 27 also reduce the risk of a pinching hazard.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A door for an elevator comprising a plurality of horizontally sliding door panels of generally the same width, and a multiple node scissors linkage for controlling the simultaneous movement of the panels between open and closed positions, the panels having their left and right vertical edges respectively substantially aligned and registered with one another when the panels lie alongside one another in an open position and having right and left edges of proximal panels adjacent one another when the panels are in a closed position, said linkage including long links having pivots at their operative ends and at their operative centers, said long links having lengths greater than the width of the door panels and being arranged such that in the closed position of the panels, said long links are substantially inclined from a horizontal plane, said links being supported by brackets extending from respective panels, said brackets being arranged to support said links in vertical planes that are parallel to said panels and when the panels are in an open position lie alongside said panels in a zone substantially between imaginary vertical planes at the edges of the panels and perpendicular to the panels.

2. A door as set forth in claim 1, wherein said linkage includes short links having operative lengths generally equal to one-half the operative length of said long length links.

3. A door as set forth in claim 2, wherein said links lie in vertical planes that are all adjacent one of said panels that travels the greatest distance between the open and closed positions of said panels.

4. A door as set forth in claim 1, wherein said linkage is vertically situated between the top and bottom of said panels.

5. A door as set forth in claim 4, wherein said links are arranged in pairs that straddle a single link.

6. A door as set forth in claim 5, wherein said links are connected to said door panels with brackets that extend from vertical edges of said door panels.

7. A door as set forth in claim 6, wherein said brackets have pivot pins spaced horizontally from both vertical edges of their respective door panels.

8. A door as set forth in claim 7, wherein said links of said linkage are all symmetrically arranged in pairs or individually about a common vertical plane spaced towards the shaft from all of said panels.

9. An elevator door assembly comprising a plurality of horizontal sliding door panels each having substantially the same width, multiple node scissors linkage for controlling the simultaneous movement of the door panels, said linkage comprising a plurality of links disposed in pairs or individually symmetrically about a common plane on a shaft side of the door panels, the linkage being disposed at an elevation between the lower and upper ends of the door panels and being arranged to register the right edges of the door panels together and the left edges of the door panels together when the door panels are parked in an open position including offset brackets attached to said door panels, said offset brackets supporting said linkage in said common plane.

10. An elevator door assembly as set forth in claim 9, wherein some of said links have operative lengths that are substantially greater than the width of the door panels.

11. An elevator door assembly as set forth in claim 9, including offset brackets attached to said door panels, said offset brackets supporting said linkage in said common plane.

12. An elevator door assembly as set forth in claim 9, wherein said brackets are secured to vertical edges of said door panels.

13. An elevator door assembly comprising a plurality of horizontal sliding door panels, multiple node scissors linkage for controlling the simultaneous movement of the door panels, said linkage comprising a plurality of links disposed in pairs or individually symmetrically about a common plane on a shaft side of the door panels, the linkage being disposed at an elevation between the lower and upper ends of the door panels, offset brackets attached to said door panels, said offset brackets supporting said linkage in said common plane, said brackets being secured to vertical edges of said door panels and having an L-shaped configuration in plan view.

14. An elevator door assembly as set forth in claim 11, wherein said brackets support pivot pins that pivotally support long links at their operational centers.

15. An elevator door assembly comprising a plurality of horizontal sliding door panels, multiple node scissors linkage for controlling the simultaneous movement of the door panels, said linkage comprising a plurality of links disposed in pairs or individually symmetrically about a common plane on a shaft side of the door panels, the linkage being disposed at an elevation between the lower and upper ends of the door panels, offset brackets attached to said door panels, said offset brackets supporting said linkage in said common plane, said brackets supporting pivot pins that pivotally support long links at their operational centers, said brackets having configurations which enable portions of said brackets to nest within one another in a plane parallel to said common plane.

* * * * *